United States Patent [19]

Harris

[11] Patent Number: 5,004,388

[45] Date of Patent: Apr. 2, 1991

[54] RETRACTABLE CLEAT DEVICE

[76] Inventor: Halford S. Harris, South Pine Ave., Live Oak, Fla. 32060

[21] Appl. No.: 279,994

[22] Filed: Dec. 5, 1988

[51] Int. Cl.[5] ..... B63B 21/04

[52] U.S. Cl. ..... 410/107; 410/111; 114/218

[58] Field of Search ..... 114/218, 189, 199, 343; 410/83, 82, 107, 111

[56] References Cited

U.S. PATENT DOCUMENTS

| | | | |
|---|---|---|---|
| 4,354,445 | 10/1982 | Kafka et al. | 114/218 |
| 4,820,093 | 4/1989 | Hirakui | 410/111 |
| 4,820,094 | 4/1989 | Hirakui et al. | 410/111 X |
| 4,890,566 | 1/1990 | Morris | 410/111 X |

FOREIGN PATENT DOCUMENTS 61-44039 3/1986 Japan .

*Primary Examiner*—Robert J. Oberleitner
*Assistant Examiner*—Alfred Muratori
*Attorney, Agent, or Firm*—Arthur G. Yeager

[57] ABSTRACT

The device has a hollow housing adaptable to be mounted in a marine deck and a spring biased cleat is telescopically vertically movable therein. The cleat has a boss which engages a rotatable pawl for locking the cleat in a retracted position below the deck line. The cleat is selectively movable to its extended operating position by releasing the locking pawl via temporary downward force on the cleat and is thereafter automatically locked upon the next temporary downward force thereon.

6 Claims, 3 Drawing Sheets

RETRACTABLE CLEAT DEVICE

BACKGROUND OF THE INVENTION

1. Field of the Invention

The present invention relates to pop-up marine hardware devices for use in securing ropes, tow lines and the like and particularly to retractable cleat devices for use in marine vessel applications.

2. Prior Art

There are a wide variety of marine hardware devices used for securing tow ropes and the like to vessels and similar vehicles. One objective of many designs is to provide a cleat that can be used in an upright position for use in securing ropes and cables while allowing the cleat to be moved downwardly out of sight and out of the way of people walking on the deck. In addition, the elevated or retracted nature of the cleat may be used to advantage in locking and releasing an attached cable as in U.S. Pat. Nos. 4,603,649—Hystad, 4,458,631—Hystad, and U.S. Pat. No. 4,423,697—Royset, and these often employ remotely operated hydraulic operating systems such as cylinders and jacks.

Devices that are designed to be retracted and therefore flush with a structural surface when not in use include U.S. Pat. Nos. 4,331,096—Lovejoy, and 3,771,488—Ecke, but these require tools such as wrenches to operate the mechanism. U.S. Pat. Nos. 4,672,909—Sweetsir and 4,354,445—Kafka disclose retractable cleats which must be lifted and turned 90° to be positioned in the upright condition. Other devices include the retractable cleat in U.S. Pat. No. 3,093,106—Lippincott which could easily be fouled by debris; and retractable cleats which employ a rotational locking feature such as those shown in U.S. Pat. Nos. 4,270,478—Kafka, 3,126,859—Bigelow, and 1,402,496—Hoffman.

A number of retractable devices have been designed for use with trucks and cargo containers. See U.S. Pat. Nos. 4,321,000—Novak, 4,092,040—Tatina, 3,892,436—Fathauer, 3,737,135—Bertolini, and 3,682,432—Lapaich. This latter group of devices work in conjunction with vehicle surfaces such as those found in trucks, trailers, and railcars.

SUMMARY OF THE INVENTION

In accord with the present invention there is provided a retractable device for installation in the deck of a boat or the like with an elongated vertical hollow housing adaptable for mounting in and to a deck and an elongated retractable member slidably positioned in the housing and movable vertically therein. The member includes an upper surface substantially flush with a top of the housing in a retracted position. A mounting means is located between the housing and the member for limiting the vertical movement of the member within the housing and selective operating means permits movement of the member from a first position wherein an upper end portion of the member is retracted in the housing and a second position wherein the member upper end portion is upraised above the housing. The selective operating means is lockable by a downward force on the upper portion to dispose the upper surface below the top of the housing and subsequent release to assume its upraised position.

Other aspects are seen in which the member includes a pair of side walls with each side wall having a vertically disposed laterally aligned slot, the mounting means has a rod affixed within the housing and passing through each of the slots for limiting the vertical movement of the member to the length of the slots. The upper end portion of the member includes a substantially horizontal plate, two spaced arms integral to the plate and extending downwardly therefrom, and a cross member connecting the arms adjacent lower ends thereof with the cross member further connecting the side walls adjacent upper ends thereof. The selective operating means includes a pawl and means mounting the pawl to the housing to be freely rotatable about a horizontal axis. The member includes a boss integral to one side wall and the boss engages the pawl for maintaining the member in a first retracted position, a compression spring means biases the member upwardly at all times.

Further aspects are provided wherein the member has a first downwardly extending post integral with the cross member, the first post being positioned on the cross member to contact and cause rotation of the pawl in a predetermined direction when the member is forced downwardly for positioning the pawl to engagingly lock against the boss and maintain the member in its retracted position when downward force on the member is thereafter removed. The pawl disengages the boss when downward force is applied to the member when it is in its retracted position. The first post causes rotation of the pawl in one direction upon application of such downward force, and the pawl is rotated by the boss when downward force is thereafter removed. The spring means moves the member upwardly such that the boss rotates the pawl in the same direction to prevent locking engagement with the boss and the member is forced to its upraised position by the spring means. The member further includes a second downwardly extending post integral to the cross member, the second post having a free end horizontally aligned with a free end of the first post. The second post engages the pawl after rotation thereof by the first post so that the pawl is in a horizontal position after the pawl has been disengaged from the boss due to a downward force applied the member in its retracted position. The boss includes a vertical wall and the pawl has elongated side walls parallel with the vertical wall of the boss when the member moves into its upraised position.

Additional aspects are seen wherein the post contacting the pawl is misaligned vertically with an axis of rotation of the pawl whereby each forcible vertical depression of the member or cleat which presses the post in contact with the pawl partially rotates same a predetermined amount to either lock the pawl onto or unlock the pawl from engagement with the boss. Another post extends downwardly and is spaced from the post and is misaligned vertically from the axis of rotation. The posts are located vertically above and laterally of the axis of rotation, and each post has a free end terminating substantially equally to cause the pawl to assume a horizontal position to assure unlocking of the cleat by the pawl. The member or cleat causes rotation of the pawl from the horizontal position to a vertical position as the member or cleat is biased upwardly by the compression spring into its second position. The pawl includes opposite end portions having respective generally V-shaped notches therein, one of the notches locking the pawl against the boss and another notch locking the pawl after being unlocked by the one notch and movement of the cleat to its upraised position. The pawl is freely rotatable and is rotated 180° by the post and the boss each time the pawl unlocks and relocks the cleat.

In another aspect of the present invention, the retractable cleat device includes a hollow tubular housing having an upper portion adaptable to be mounted substantially flush on a marine deck, and a lower portion adaptable for extending below a marine deck. The device also includes a cleat having an upper portion and a lower portion with the lower portion telescopically slidably mounted within the lower portion of the housing. The cleat is vertically movable to dispose its upper portion above the upper portion of the housing when unlocked and a retaining means located between the cleat and housing limits the vertical movement of the cleat and prevents removal of the cleat from the housing. Selective engaging means locks the cleat in a first retracted position within the housing and includes a rotatable mounted pawl having a pair of oppositely disposed ends each shaped as a V-notch. A member mounted on the cleat engages the pawl and causes partial rotation thereof when the cleat is forcibly moved downwardly. The selective engaging means also includes an internal shoulder on the cleat engaged by one notch to limit further vertical movement of the cleat when the pawl has been partially rotated to position one notch in contact with the shoulder and compression spring means for biasing the cleat maintains engagement between the shoulder and one notch of the pawl when the cleat is locked. The shoulder causes partial rotation of the pawl after the cleat is unlocked by downward movement of the cleat and partial rotation of the pawl by the member. The hollow housing includes a front wall, a rear wall, a bottom and two opposite side walls. The cleat has two side walls each of which has vertical and aligned slots. The retaining rod extends through the aligned slots and is affixed to each of housing side walls and the vertical movement of the cleat is limited by the vertical distance of the slots. The pawl has a generally rectangular shape with minor notch sides and major sides. The minor sides having a first inwardly tapered surface and a second inwardly tapered surface. A post is mounted on the cleat for engaging the pawl and causing it to pivot when the cleat is moved downwardly. The shoulder or boss is integral with one side wall of the cleat and is formed by a substantially vertical interior wall. One pawl notch surface engages the interior wall to limit further vertical movement of the cleat when the pawl has been partially pivoted to position the surface parallel and juxtaposed with the interior wall. The compression spring biases the cleat upwardly for maintaining locking engagement between the boss and pawl. After an unlocking force is applied downwardly on the cleat the spring raises the cleat to its upraised position with its upper portion above the upper portion of the housing.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
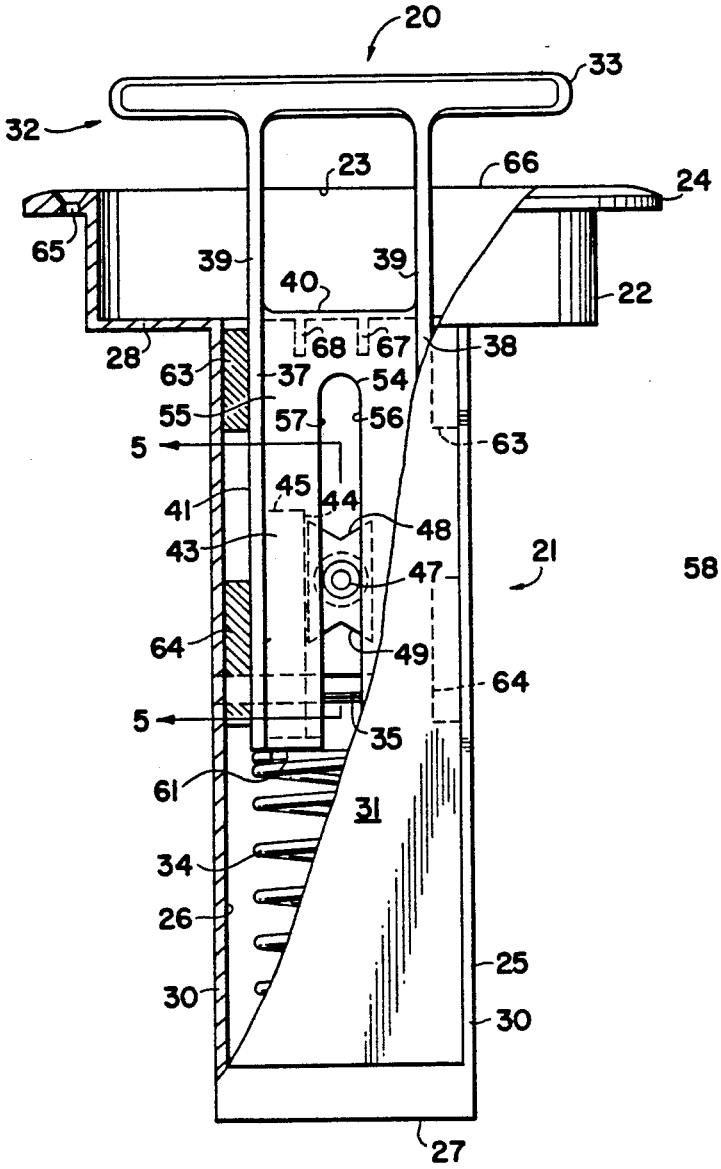
FIG. 1 is a front elevational view of the retractable cleat device in accord with the present invention with the outer and inner housing partially broken away.

Referring now to the drawings, the retractable cleat device in accord with the present invention is generally depicted by the numeral 20 in FIG. 1. An outer housing 21 is comprised of an upper portion 22 defining a hollow interior 23 and having a laterally extending flange 24 adapted to be positioned on a deck of a marine vessel or the like. A lower portion 25 of housing 21 is reduced and defines a hollow interior space 26 with bottom 27 being parallel to flange 24. Planar shoulders 28 extend elongated laterally outwardly of lower portion 25 to provide the interior space 23. The lower portion 25 of housing 21 is further defined by a back wall 29, spaced side walls 30, and a removable front cover 31. In the preferred embodiment of the invention, the retractable cleat is formed of materials acceptable for use in a marine environment such as chrome-plated brass.

Figure 2:
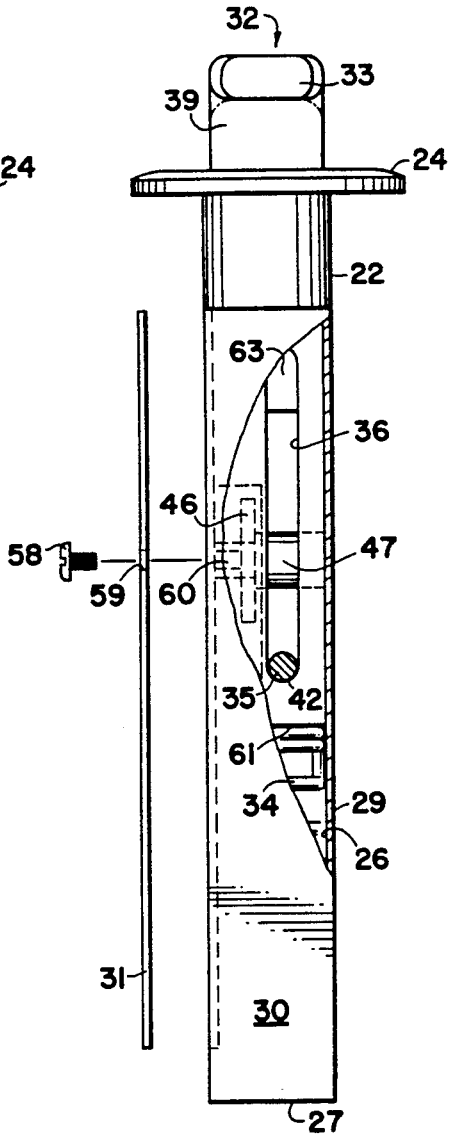
FIG. 2 is an exploded right side elevational view of the cleat device of FIG. 1 partially broken away.

The cleat 32 is movable vertically within the housing 21 by applying a sufficient downward force onto the upper plate member 33 of the cleat by an operator. Cleat 32 is biased by spring 34 in the upward direction. The limit of travel of cleat 32 is established by the positioning of a press fit transverse rod 35 that is mounted through the side walls 30 of housing 21, such rod being caged within aligned slots 36 in cleat side walls 37 and 38. Cleat 32 has two spaced arm members 39 integral with plate member 33 and cross member 40 which is generally positioned in substantial alignment with shoulders 28 when the cleat is extended in the upmost position of FIG. 1. A first side wall 37 and a second side wall 38 subtend downwardly from cross member 40 and are extensions of arm members 39 and define the lower portion 41 of cleat 32. As illustrated in FIG. 2, two aligned slots 36 are cut out of side walls 37 and 38 which allows for vertical movement of cleat 32 with upper travel limited by rod 35 when contact is made with each bottom 42 of each slot 36.

Figure 4:
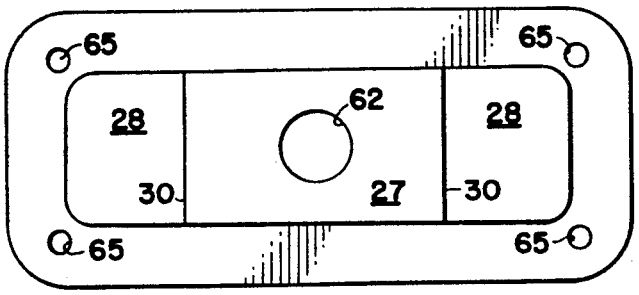
FIG. 4 is a bottom plan view of the cleat device of FIG. 1.
Figure 5:
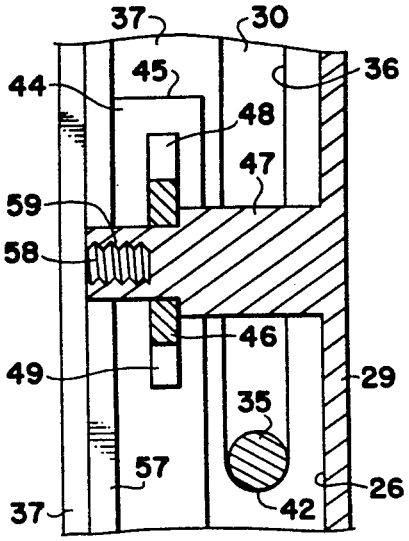
FIG. 5 is an enlarged partial cross sectional view of the internal locking apparatus of the cleat device of FIG. 1 taken along the line 5—5.

The lower portion 41 of cleat 32 includes a boss 43 integral with the first side wall 37 and having an interior side 44 and upper surface 45. Pawl 46 is rotatably mounted on boss or post 47 which functions as an axle allowing pawl 46 to rotate freely. Pawl 46 has a generally rectangular shape with identical notches 48, 49 on opposite ends. Each notch 48, 49 has a first tapered surface 50, 51 and second tapered surface 52, 53 respectively, that are cut at the same angles with respect to the longitudinal axis of pawl 46. As explained in detail herein below, pawl 46 engages boss 43 on the upper surface 45 and side 44 during vertical operation of the cleat 32. As illustrated in FIG. 1, cleat 32 is free to move vertically in the slot 54 in cleat front wall 55 defined by sides 56 and 57 to allow cleat 32 to move with respect to post 47 and housing 21. In addition, cover 31 is releasably secured to post 47 via bolt 58, through hole 59, which is threadedly fastened into a tapped hole 60 without any interference with cleat 32 or pawl 46. Slot 54 extends to the bottom edge 61 of front wall 55 and allows for ease of assembly of the retractable cleat device 10 in accord with the present invention. The bottom of cleat 32 is partly open to aid in the removal of water via drain hole 62 in housing 11, as seen in FIG. 4. Proper lateral alignment of the cleat 32 within housing 21 is assured by way of upper and lower pairs of spaced cleat guides or shim bearings 63 and 64 which are respectively integral with side walls 30.

Figure 3:
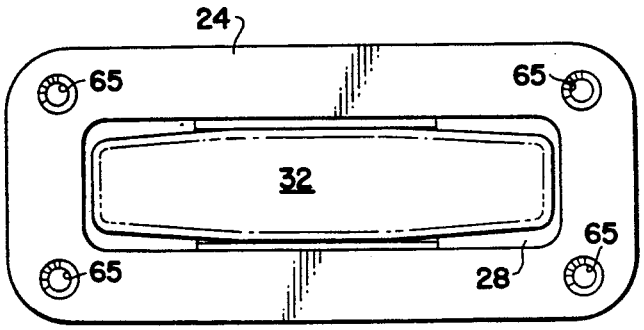
FIG. 3 is a top plan view of the cleat device of FIG. 1.

Housing 21 is mounted on a boat deck (not shown) via screws (not shown) that are secured into countersunk or chamfered holes 65, best seen in FIGS. 1, 3, and 4. The housing 21 is positioned to be substantially flush with the boat deck. When cleat 32 is retracted, plate member 33 will be in its retracted position generally below line 66 in FIG. 1.

Figure 6:
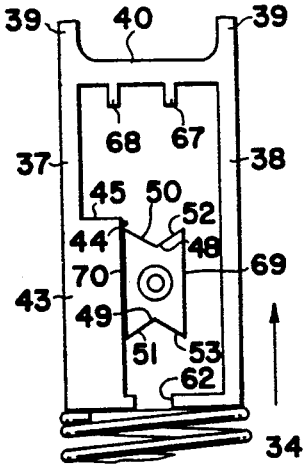
FIGS. 6–12 are pictorial views of the operation of the locking apparatus of the cleat device of FIG. 1.

The operation of the invention will now be described with reference to the simplified pictorial illustrations of FIGS. 6–12. In FIG. 6, the cleat 32 is shown in its upraised position where it may be used to secure a rope or tow line. With cleat 32 at its upper travel limit, pawl 46 is near the bottom 61 of the lower portion 41 of the cleat 32 and is aligned vertically. Notched ends 48 and 49 are identical in having two inwardly tapered surfaces 50 and 52 for notch 48, 51, and 53 for notch 49. Cross member 40 has two downwardly extending posts 67 and 68. Post 67 is vertically aligned with side 56 of slot 54 and thus offset from the axis of pawl 46 to cause rotation thereof. Post 68 is aligned with interior surface 44 of boss 43 as clearly shown in FIG. 1. Pawl 46 has major sides 69 and 70 as illustrated more clearly in FIGS. 6–12.

Figure 7:
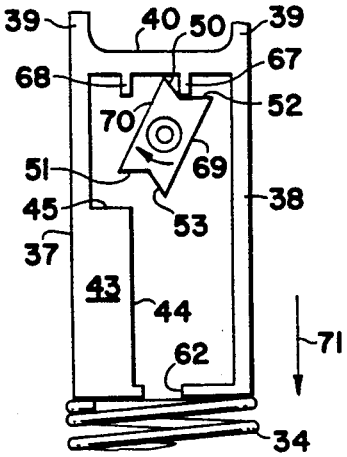
Figure 8:
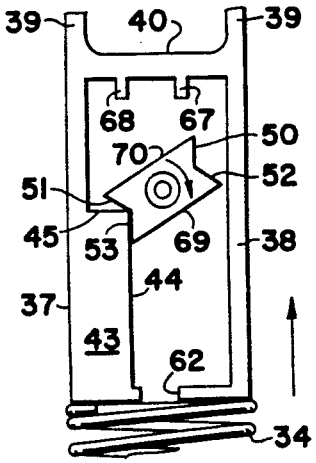

To retract cleat 32, downward force 71 is applied by the operator to plate member 33 causing plate member 33 to be moved downwardly within upper housing 22 and engaging post 67 extending from cross member 40 to come into contact with tapered surface 52 of notch 48 as illustrated in FIG. 7. This contact results in a clockwise rotation of pawl 46 which places surface 51 of notch 49 directly above boss 43. As the downward force 71 on plate member 33 is removed, spring 34 will force cleat 32 upward until boss 43 comes into contact with notch 49 as shown in FIG. 8. Upper surface 45 of boss 43 will force pawl 46 to rotate clockwise sufficiently so that surface 53 is flush with the interior wall 44 of boss 43. Further rotation of pawl 46 is thereby prevented by surface 53 contacting wall 44 and further upper travel of cleat 32 is also prevented. Cleat 32 is therefore in its retracted position.

Figure 9:
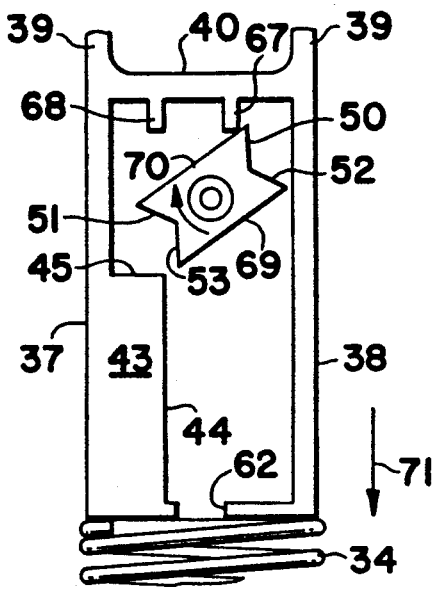
Figure 10:
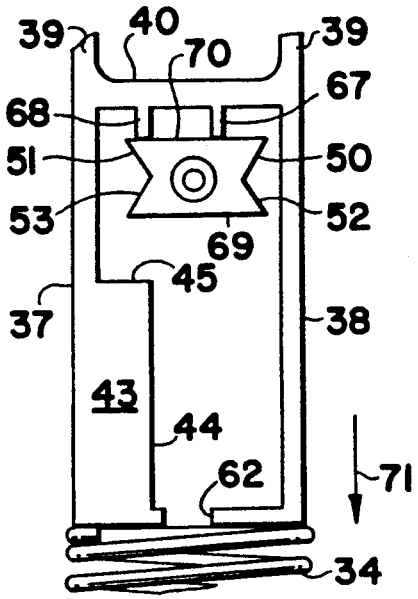
Figure 11:
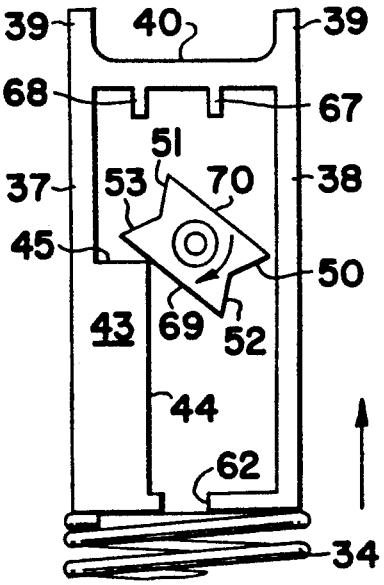
Figure 12:
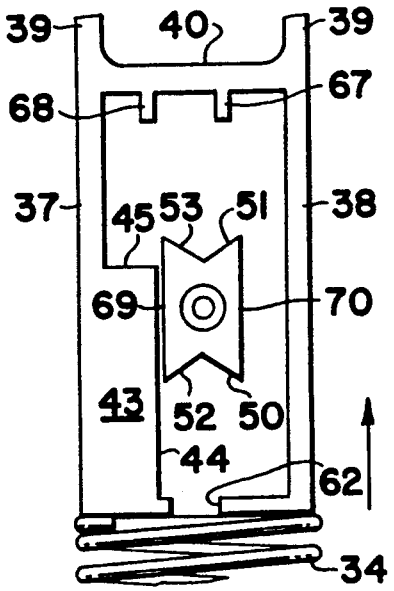

Considering FIG. 9 cleat 32 may be returned to its upright position by applying a downward pressure or force 71 to planar member 33. Even with the cleat 32 in the retracted position, there is sufficient clearance for vertical movement between plate member 33 and interior lateral shoulders 28 of space 23 to allow cleat 32 to be moved downward to the position illustrated in FIG. 9. The length of pawl 46 is sized so that post 67 will contact the side 70 of pawl 46 causing further clockwise rotation with the result that the pawl 46 will then be positioned horizontally, as illustrated in FIG. 10. Post 68 will also make contact with side 70 of pawl 46 as illustrated in FIG. 10 to assure the horizontal positioning thereof. If post 68 was not extending downwardly from cross member 40 exactly the same extent as post 67, pawl 46 would rotate beyond the horizontal and cause a malfunction, i.e., side 70 of pawl 46 would make contact with member 40 and post 67 resulting in a lateral force being applied to post 67 and with repeated use could cause bending or breakage of the post 67 and or excessive wear of the edge formed between side 70 and surface 50. However, post 68 is utilized to reduce wear on the pawl 46 and substantially extends the life of the cleat device shown herein.

With pawl 46 in the horizontal position as in FIG. 10, a release of downward force 71 on planar member 33 will cause boss 43 to come into contact with side 69 of the pawl 46 via the compressed spring 34. Pawl 46 will then be rotated clockwise as shown first in FIG. 11, and then into its position in FIG. 12. From the position of FIG. 12, the pawl 46 is aligned vertically with interior wall 44 of boss 43. Cleat 32 then is pushed upward via spring 34 to its upright position, as illustrated in FIGS. 1 and 6. Repeated operation of the cleat 32 is exactly as described above with a 180 degree rotation of pawl 46 during each cycle from upright to retracted position of cleat 32 in accord with the present invention.

The retractable cleat 20 in accord with the present invention is operable without the use of any tool such as wrenches and the like. In addition, it is most unlikely that debris can foul the operating mechanism, such as pawl 46, as can happen with prior art devices which have several moving parts exposed to the environment.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A retractable device for installation in a deck of a boat comprising an elongated vertical hollow unitary housing adaptable for mounting in and to a deck, said housing having a top surface adapted to be mounted flush with the deck, an elongated retractable member slidably positioned in said housing and movable vertically therein, said member having an upper surface substantially flush with said top surface of said housing in a retracted position; mounting means between said housing and said member for limiting the vertical movement of said member, selective operating means for moving said member from a first position wherein an upper end portion of said member is retracted in said housing to position said upper surface flush with said top surface and a second position wherein said member upper end portion is upraised above said top surface of said housing, said selective operating means disposed within said housing and being lockable by a downward force on said upper portion to dispose said upper surface substantially below said top surface of said housing and subsequent release to assume said first position and being thereafter releasable by another downward force on said upper end portion to dispose said upper surface substantially below said top surface and subsequent release to assume said second position, said housing having a plurality of interior surfaces, said interior surfaces being located spacedly away from said retractable member to allow movement of said member within said housing and for ease of assembly of said member through said top surface of said housing while said housing is mounted in the deck.

2. The retractable device as defined in claim 1 wherein said mounting means includes rod means affixed within said housing and extending laterally therein for engagement with said member for limiting the vertical movement of said member.

3. The retractable device as defined in claim 1 wherein said selective operating means includes a movable means for positioning said member in said first and second positions, means mounting said movable means to said housing to be freely rotatable about an axis, and compression spring means for biasing said member upwardly.

4. A retractable device for installation in a deck of a boat comprising:

a unitary hollow housing including an open front portion, a rear wall, a bottom and two opposite side walls, said housing having an upper surface adaptable for mounting flush with the deck and a lower portion extending below the deck; a removable panel removably affixed to said front portion of said housing;

a cleat slidably positioned within said housing and having an upper portion which is movable vertically a substantial distance above and below said upper surface, said upper portion of said cleat raised above said upper surface of said housing when said cleat is unlocked and being at least flush therewith when said cleat is locked, said cleat having two side walls, said side walls having respective vertical and aligned slots;

a retaining rod means extending into said aligned slots and being affixed to said side walls of said housing for limiting the vertical movement of said cleat to the vertical distance of said slots;

selective engaging means mounted within said housing for locking said cleat in a first retracted position, said cleat when depressed downwardly causing first movement of said selective engaging means to unlock said cleat from said first retracted position, said cleat being unlockable by being subsequently depressed downwardly to cause second movement of said selective engaging means, said upperportion of said cleat being moved a substantial distance below said upper surface of said housing when said cleat is depressed downwardly to cause respective said first and second movement of said selective engaging means; and compression spring means positioned in said housing for biasing said cleat upwardly after said second movement of said selective engaging means to raise said cleat to its upraised position with said upper cleat portion being above said housing upper surface, removable means affixing said front panel to said front portion for providing access through said open front portion to said cleat, said selective engaging means and said compression spring means for ease of assembly while said housing is mounted in the deck.

5. In the retractable device of claim 4 wherein said selective engagement means includes an element freely rotatable about an axis, said element being rotated by movement of said cleat each time said cleat is moved downwardly below the deck.

6. A retractable device for installation in a deck of a boat comprising:

a unitary hollow housing including an open front portion, a rear wall, a bottom and two opposite side walls, said housing having an upper portion with its top surface adaptable for mounting substantially flush with the deck and a lower portion extending below the deck; a removable panel adapted to be affixed to said front portion of said housing;

a cleat slidably positioned within said housing and being adapted to be locked in a retracted position by vertical movement therein, said cleat having an upper portion raised above said upper portion of said housing when said cleat is unlocked and being at least flush with said top surface when said cleat is locked in said retracted position, said cleat having two side walls, said side walls having respective vertical and aligned slots;

rod means affixed to said side walls of said housing and extending laterally into respective said slots to engage said cleat for limiting the vertical movement of said cleat to the vertical distance of said slots;

movable selective engaging means mounted within said housing for locking said cleat in said retracted position when said cleat is depressed downwardly to cause movement of said selective engaging means, said selective engaging means having subsequent movement by subsequent downward depression of said cleat for unlocking said cleat, said cleat being movable substantially below said top surface of said housing during both said movement and said subsequent movement of said selective engaging means by respective downward depression of said cleat; and compression spring means positioned within said housing for biasing said cleat upwardly after said subsequent movement of said selective engaging means to raise said cleat to its unlocked position with said upper cleat portion being above said housing upper portion, removable means affixing said panel to said front portion for accessing said cleat, said movable selective engaging means, and said spring means for maintenance thereof while said housing is mounted in the deck and removal of said spring means and said movable engaging means through said open front portion.

* * * * *